US009252535B2

(12) United States Patent
Nakamura

(10) Patent No.: US 9,252,535 B2
(45) Date of Patent: Feb. 2, 2016

(54) TERMINAL CONNECTING STRUCTURE

(71) Applicant: YAZAKI CORPORATION, Minato-ku, Tokyo (JP)

(72) Inventor: Masatoshi Nakamura, Makinohara (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 14/459,414

(22) Filed: Aug. 14, 2014

(65) Prior Publication Data

US 2014/0357138 A1 Dec. 4, 2014

Related U.S. Application Data

(63) Continuation of application No. PCT/JP2012/081240, filed on Dec. 3, 2012.

(30) Foreign Application Priority Data

Feb. 15, 2012 (JP) ..... 2012-030696

(51) Int. Cl.

| | |
|---|---|
| ***H01R 13/115*** | (2006.01) |
| ***H01R 13/629*** | (2006.01) |
| ***H01R 13/04*** | (2006.01) |
| ***H01R 13/11*** | (2006.01) |
| *H01R 4/18* | (2006.01) |
| *H01R 13/187* | (2006.01) |

(52) U.S. Cl.

CPC ..... *H01R 13/629* (2013.01); *H01R 13/04* (2013.01); *H01R 13/113* (2013.01); *H01R 4/185* (2013.01); *H01R 13/187* (2013.01)

(58) Field of Classification Search

CPC ..... H01R 13/115; H01R 13/113; H01R 13/11

See application file for complete search history.

(56) References Cited

U.S. PATENT DOCUMENTS

| | | | | |
|---|---|---|---|---|
| 3,586,796 | A * | 6/1971 | Simovits et al. | 200/6 BA |
| 4,764,133 | A * | 8/1988 | Kaneko | 439/889 |
| 5,035,655 | A * | 7/1991 | Hesse | 439/699.2 |

(Continued)

FOREIGN PATENT DOCUMENTS

| | | | |
|---|---|---|---|
| CN | 102148449 | A | 8/2011 |
| DE | 102010011547 | A1 | 9/2011 |

(Continued)

OTHER PUBLICATIONS

The extended European search report letter issued on Sep. 8, 2015 in the counterpart European patent application.

(Continued)

*Primary Examiner* — Gary Paumen

(74) *Attorney, Agent, or Firm* — Marvin A. Motsenbocker; Mots Law, PLLC

(57) ABSTRACT

A terminal connecting structure is provided with a male terminal having a tab portion and a female terminal having a contact portion. The tab portion and the contact portion mutually slide. A sliding surface of the tab portion extends in a direction inclined with respect to a sliding direction of the tab portion and the contact portion and has a projecting wall and a recess portion provided alternately along the sliding direction. A sliding surface of the contact portion extends in a direction crossing the projecting wall and the recess portion and has a projecting wall and a recess portion provided alternately along the sliding portion.

20 Claims, 6 Drawing Sheets

(56) References Cited

U.S. PATENT DOCUMENTS

| | | | | |
|---|---|---|---|---|
| 5,186,665 | A | 2/1993 | Kelly et al. | |
| 5,281,178 | A * | 1/1994 | Biscorner | 439/845 |
| 5,989,053 | A * | 11/1999 | Wheeler | 439/387 |
| 7,494,359 | B2 | 2/2009 | Ragnarsson | |
| 8,485,853 | B2 * | 7/2013 | Seifert et al. | 439/882 |
| 2009/0253314 | A1 * | 10/2009 | Shimizu | 439/852 |
| 2010/0087105 | A1 * | 4/2010 | Gump et al. | 439/879 |
| 2013/0115830 | A1 * | 5/2013 | Seifert et al. | 439/888 |
| 2014/0220835 | A1 * | 8/2014 | Seipel et al. | 439/877 |

FOREIGN PATENT DOCUMENTS

| | | | |
|---|---|---|---|
| JP | S51-6694 | | 2/1976 |
| JP | S61-26282 | U | 2/1986 |
| JP | H06-111870 | A | 4/1994 |
| JP | 2000-188028 | A | 7/2000 |
| JP | 2001-266990 | A | 9/2001 |
| JP | 2006-172877 | A | 6/2006 |
| JP | 2008-041315 | A | 2/2008 |

OTHER PUBLICATIONS

Chinese office action issued on Nov. 4, 2015 in the counterpart Chinese patent application.

* cited by examiner

TERMINAL CONNECTING STRUCTURE

CROSS REFERENCE TO RELATED APPLICATIONS

This application is a continuation of International Application No. PCT/JP2012/081240, filed on Dec. 3, 2012, which claims priority to Japanese Patent Application No. 2012-030696, filed on Feb. 15, 2012, the entire contents of which are incorporated by references herein.

BACKGROUND OF THE INVENTION

1. Field of the Invention

The present invention relates to a terminal connecting structure in which each of contact portions of a plurality of terminals mutually slides and is brought into contact with each other.

2. Description of the Related Art

As a structure for connecting terminals of connectors to each other, a structure in which a first contact portion of a first terminal and a second contact portion of a second terminal mutually slide and are brought into contact with each other has been proposed. When a connector having this structure is used in an environment with vibration, thermal shock, a temperature humidity cycle and the like, the first terminal and the second terminal slightly slides with respect to each other, and this slight sliding causes chipping of surface plated layers (tinning, for example) of the first contact portion and the second contact portion, and abrasion powders are generated. If the abrasion powders are present between the first contact portion and the second contact portion, contact resistance increases.

When a contact load between the first contact portion and the second contact portion is large (4.0 N, for example), a slight sliding distance between the first contact portion and the second contact portion is kept short, and an abrasion powder amount generated by the slight sliding can be kept small.

However, with recent size reduction of connectors, when the contact load between the first contact portion and the second contact portion becomes small (1.0 N or less, for example), the slight sliding distance between the first contact portion and the second contact portion becomes large, and the abrasion powder amount generated by the slight sliding increases, which lowers durability of a terminal.

Japanese Patent Laid-Open Publication No. 2000-188028 proposes a terminal connecting structure for solving the above described problem. FIG. 6 illustrates this contact connecting structure. The contact connecting structure of Patent Literature 1 has a movable terminal 50 and a fixed terminal 60. The movable terminal 50 has an arc-shaped movable contact portion 51. The fixed terminal 60 has a fixed contact portion 61 on which the movable contact portion 51 slides. A sliding surface of the fixed contact portion 61 has a plurality of grooves 62. The grooves 62 extend along a sliding direction (terminal moving direction) S and are formed at intervals.

In the above configuration, during connection or slight sliding of the terminal, the contact portion 51 of the movable terminal 50 slides on the fixed contact portion 61 of the fixed terminal 60. When abrasion powders are generated in this process, the abrasion powders move with movement of the movable contact portion 51 and a part of them enters the grooves 62. As a result, an amount of the abrasion powders present between the movable contact portion 51 and the fixed contact portion 61 can be reduced, and an increase of contact resistance can be suppressed.

SUMMARY OF THE INVENTION

However, in the above described terminal connecting structure, the abrasion powders generated on the movable contact portion 51 or the fixed contact portion 61 cannot enter the grooves 62 without changing to a direction orthogonal to the sliding direction S. Thus, only a slight part of the abrasion powders enters the groves 62, and the amount of the abrasion powders present between the movable contact portion 51 and the fixed contact portion 61 cannot be reduced much. As a result, an increase of the contact resistance cannot be effectively suppressed.

Thus, the present invention was made in order to solve the above problem and has an object to provide a terminal connecting structure which can effectively suppress the increase of contact resistance caused by the abrasion powders.

An aspect of the present invention is a terminal connecting structure provided with a first terminal including a first contact portion and a second terminal including a second contact portion configured to slide on the first contact portion, in which the first contact portion and the second contact portion mutually slide and are brought into contact with each other, a sliding surface of the first contact portion extends in a direction inclined with respect to a sliding direction of the first contact portion and the second contact portion and has a first projecting wall and a first recess portion provided alternately along the sliding direction, and a sliding surface of the second contact portion extends in a direction crossing the first projecting wall and the first recess portion and has a second projecting wall and a second recess portion provided alternately along the sliding direction.

Widths and depths of the first recess portion and the second recess portion may be set to widths and depths equal to or larger than an expected maximum grain diameter of an abrasion powder.

Inclination angles of the first projecting wall and the first recess portion and inclination angles of the second projecting wall and the second recess portion may be set within a range of 30 to 60 degrees, respectively.

According to the present invention, during terminal connecting or slight sliding, if the first contact portion and the second contact portion mutually slide (including slight sliding) and the sliding generates abrasion powders of metal plating or the like on the first contact portion and the second contact portion, the abrasion powders move by following sliding of the first contact portion and the second contact portion. Here, contact points of the first contact portion and the second contact portion are distributed in a grid shape. The abrasion powders located on these contact points enter the first recess portion and the second recess portion when they move with the first contact portion and the second contact portion regardless of the moving direction. As a result, the amount of the abrasion powders present between the first contact portion and the second contact portion can be sufficiently reduced, and an increase of contact resistance caused by the abrasion powders can be effectively suppressed.

BRIEF DESCRIPTION OF THE DRAWINGS

FIGS. 1A and 1B illustrate a male terminal and a female terminal according to an embodiment of the present invention, in which FIG. 1A is a sectional view before contact between the both terminals and FIG. 1B is a sectional view when the contact between the both terminals is completed.

FIGS. 2A to 2C illustrate a contact portion of the male terminal according to the embodiment of the present invention, in which FIG. 2A is a plan view of its essential part, FIG. 2B is an enlarged view of D1 in FIG. 2A, and FIG. 2C is an A-A line sectional view of FIG. 2B.

FIGS. 3A to 3C illustrate a contact portion of the female terminal according to the embodiment of the present invention, in which FIG. 3A is a plan view of its essential part, FIG. 3B is an enlarged view of D2 in FIG. 3A, and FIG. 3C is a B-B line sectional view of FIG. 3B.

FIGS. 4A to 4C illustrate projecting walls according to the embodiment of the present invention, in which FIG. 4A is an enlarged sectional view, and FIGS. 4B and 4C are enlarged sectional views of variations of the projecting wall, respectively.

FIGS. 5A and 5B illustrate a contact state at each of the contact portions of the male terminal and the female terminal according to the embodiment of the present invention, in which FIG. 5A is a view illustrating spots where each of the contact portions is in direct contact with each other in cross-hatching, and FIG. 5B is a view for explaining a state in which each of the contact portions moves relatively by slight sliding.

DESCRIPTION OF THE PREFERRED EMBODIMENTS

An embodiment of the present invention will be described below on the basis of the attached drawings.

A connector device to which a terminal connecting structure according to this embodiment is applied is provided with a first connector (not shown) and a second connector (not shown). The first connector has a first connector housing (not shown) and a male terminal 1 formed as a first terminal and fixed in this first connector housing (see FIGS. 1A and 1B). The second connector has a second connector housing (not shown) and a female terminal 10 formed as a second terminal and fixed in this second connector housing (see FIGS. 1A and 1B). The first connector housing and the second connector housing are configured capable of being fitted with each other. When the first connector housing and the second connector housing are fitted with each other, the male terminal 1 and the female terminal 10 are in contact by an elastic deforming force.

Figure 1A:
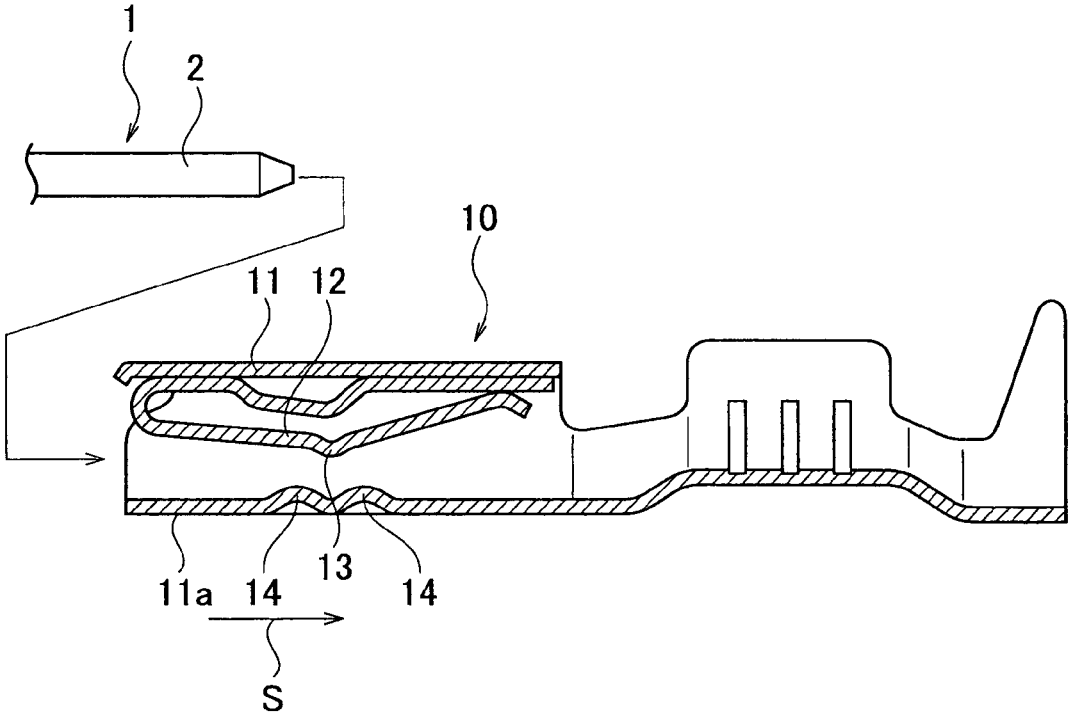
Figure 1B:
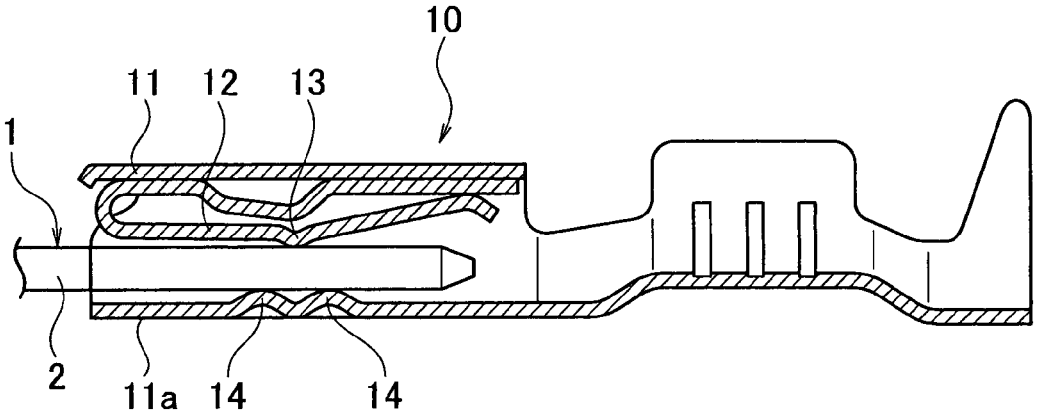
Figure 2A:
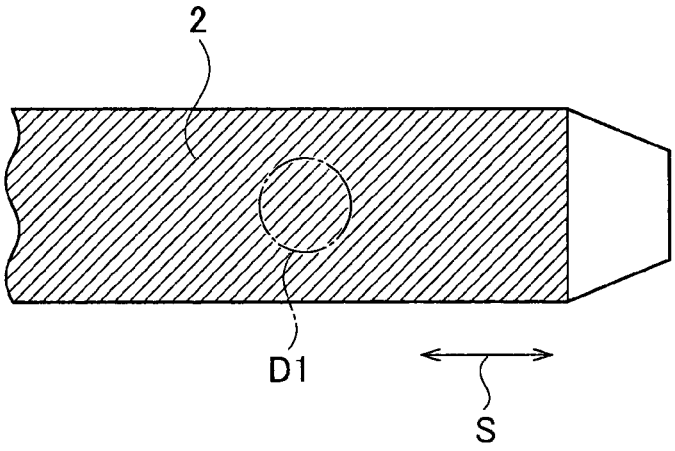
Figure 2B:
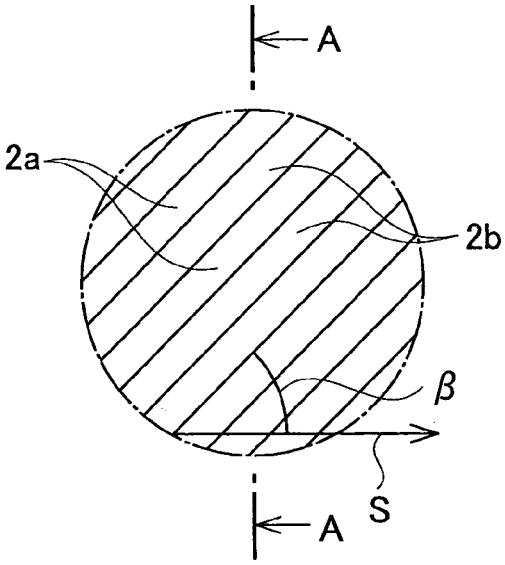
Figure 2C:
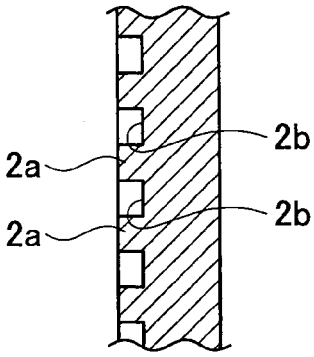
Figure 3A:
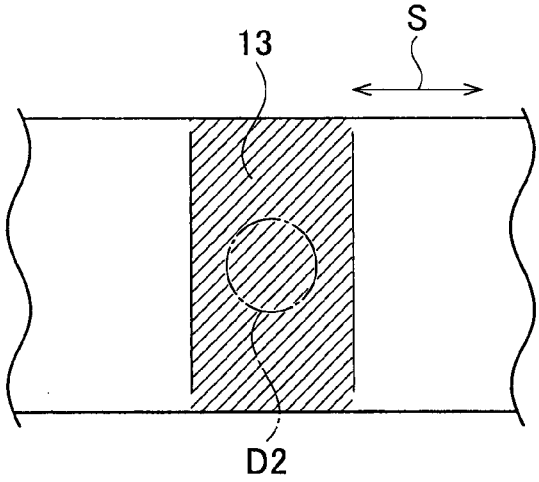
Figure 3B:
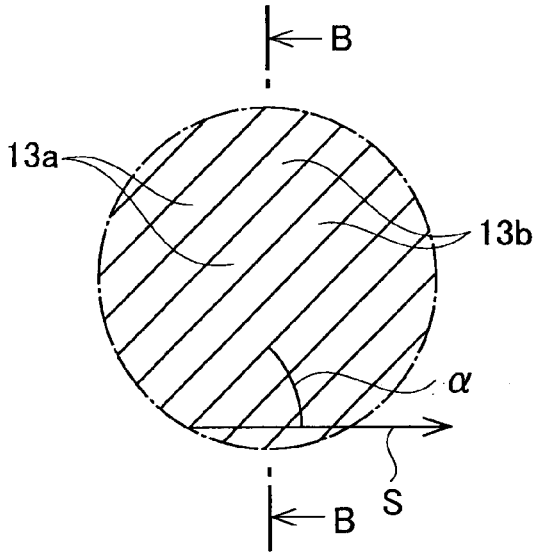
Figure 3C:
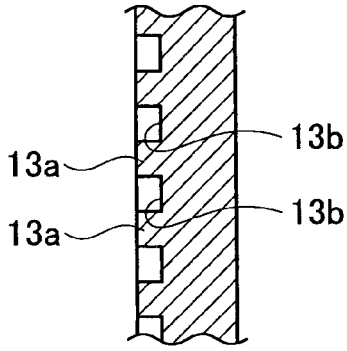
Figure 4A:
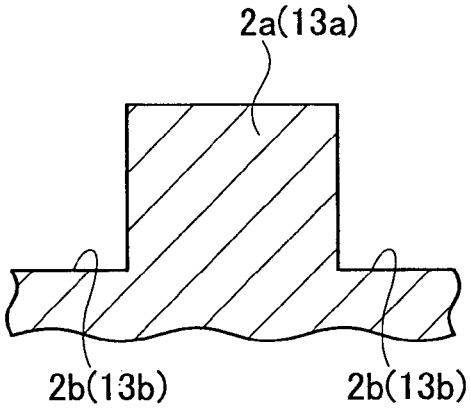

As illustrated in FIGS. 1A and 1B, the male terminal 1 is formed of a conductive member. A surface of the male terminal 1 is applied with tin (Sn) plating. The male terminal 1 has a tab portion 2 formed as a male-side contact portion. The tab portion 2 has a sliding surface in slidable contact with a contact portion 13 of the female terminal 10 (see FIGS. 3A to 3C). Moreover, as illustrated in FIGS. 2A to 2C, the sliding surface of the tab portions 2 extends in a direction inclined to a sliding direction S and also has a first projecting wall 2*a* and a first recess portion 2*b* provided alternately along the sliding direction S. The sliding direction S is a direction in which the male terminal 1 is inserted into the female terminal 10 or a direction in which the male terminal 1 is removed from the female terminal 10. An inclination angle $\alpha$ of each of the extending directions of the first projecting wall 2*a* and the first recess portion 2*b* to the sliding direction S is set within a range of 30 to 60 degrees. As illustrated in FIG. 4A, a sectional shape of the first projecting wall 2*a* is a square. A width and a depth of the first recess portion 2*b* is set to a width and a depth equal to or larger than an expected maximum grain diameter of an abrasion powder Q (see FIGS. 5A and 5B). In more detail, in the case of tinning, since the grain diameter of the abrasion powder Q is approximately 0.1 to 10 μm, the width and the depth of the first recess portion 2*b* is set to 10 μm or more.

The female terminal 10 is formed by pressing a conductive member. The female terminal 10 has a box frame body 11 which is open in a front thereof. An elastic arm portion 12 is provided on an upper surface in the box frame body 11. The elastic arm portion 12 has a contact portion 13 formed as a female side contact portion. The contact portion 13 is formed by bending its constituent member and protrudes downward. The contact portion 13 has a sliding surface in slidable contact with the tab portion 2 of the male terminal 1. As illustrated in FIGS. 3A to 3C, the sliding surface of the contact portion 13 extends in a direction crossing the first projecting wall 2*a* and the first recess portion 2*b* and also has a second projecting wall 13*a* and a second recess portion 13*b* provided alternately along the sliding direction S. That is, when the sliding surface of the contact portion 13 directly faces the sliding surface of the tab portion 2, the second projecting wall 13*a* and the second recess portion 13*b* are inclined in a direction opposite to that of the first projecting wall 2*a* and the first recess portion 2*b*. An inclination angle $\beta$ of each of the extending directions of the second projecting wall 13*a* and the second recess portion 13*b* with respect to the sliding direction (terminal insertion direction and terminal removing direction) S is set within a range of 30 to 60 degrees. As illustrated in FIG. 4A, a sectional shape of the second projecting wall 13*a* is a square. A width and a depth of the second recess portion 13*b* are set to a width and a depth equal to or larger than the expected maximum grain diameter of the abrasion powder Q. In more detail, in the case of tinning, since the grain diameter of the abrasion powder Q is approximately 0.1 to 10 μm, the width and the depth of the second recess portion 13*b* is set to 10 μm or more.

A lower surface portion 11*a* of the box frame body 11 has two contact piece portions 14. Each of the contact piece portions 14 is formed by bending of its constituent member.

Figure 5B:
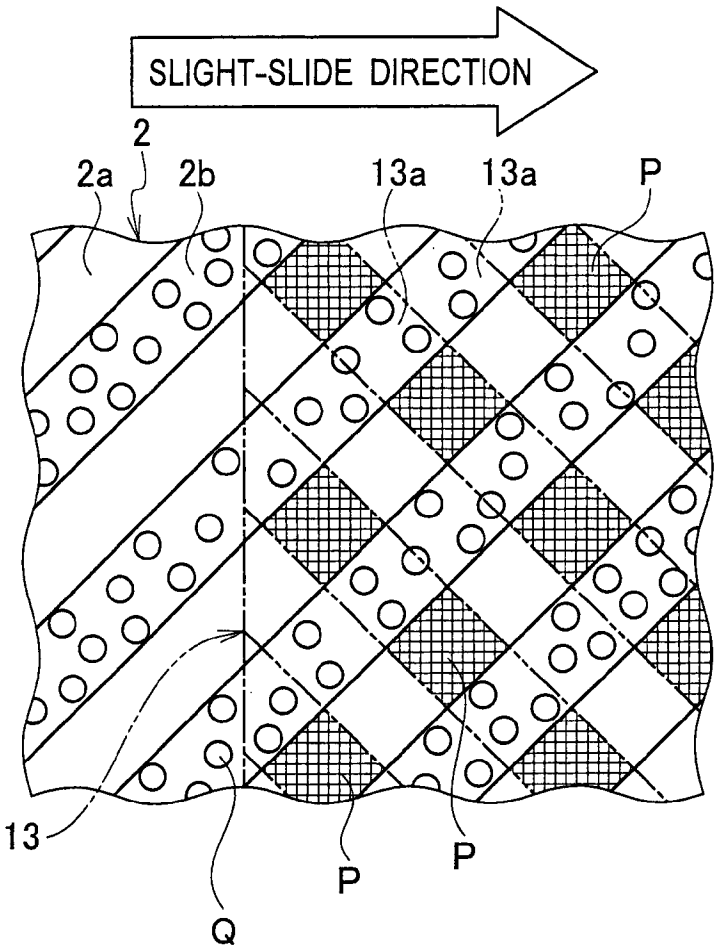
Figure 5A:
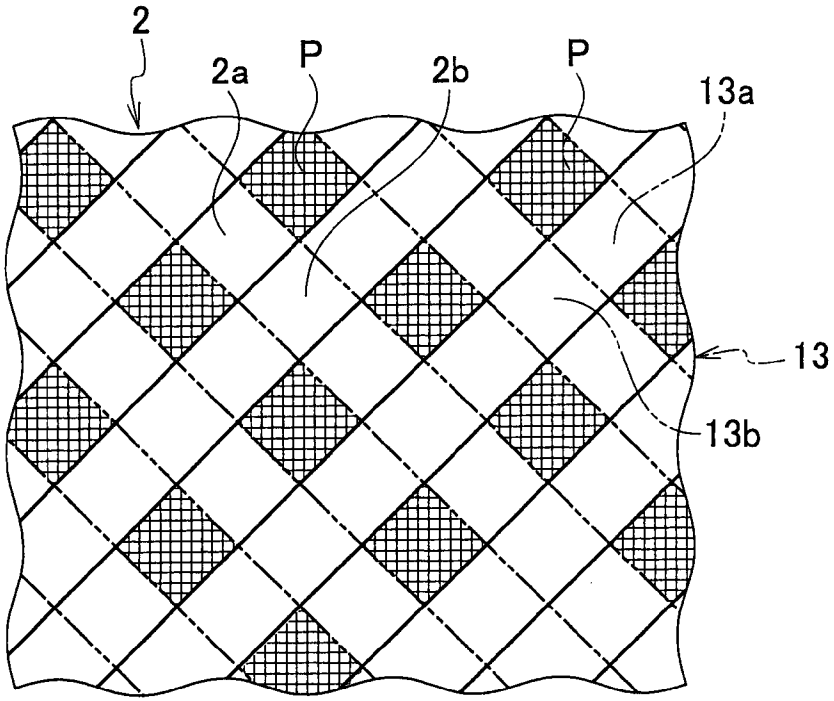
Figure 6:
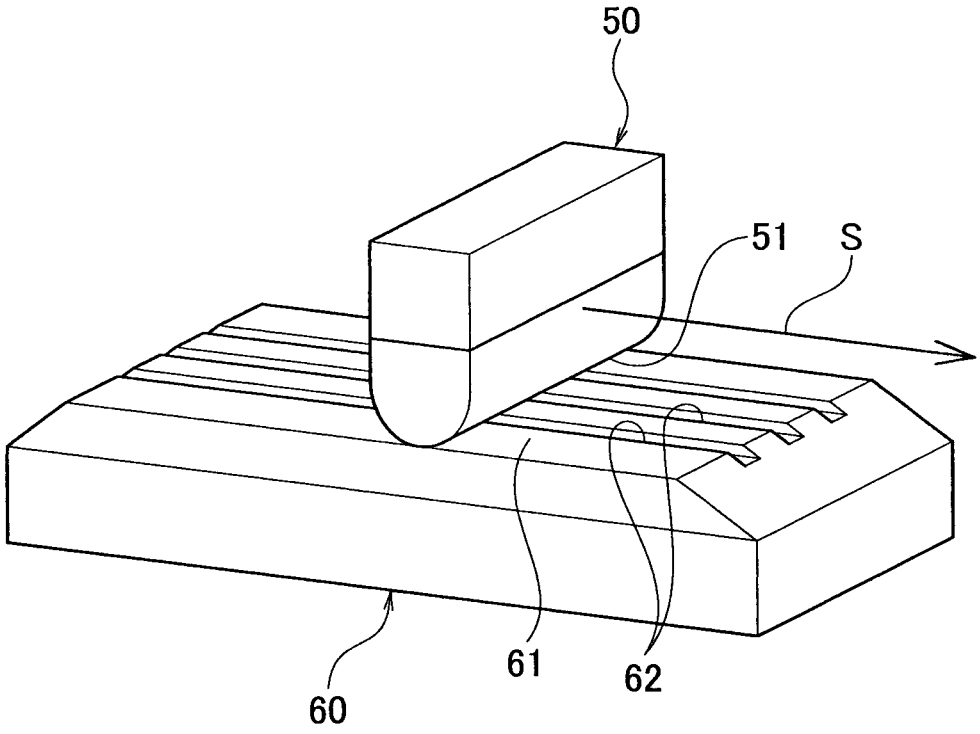
FIG. 6 is a perspective view of a conventional terminal connecting structure.

When the tab portion 2 of the male terminal 1 is inserted into the box frame body 11 of the female terminal 10 from the state in FIG. 1A, a tip end side of the tab portion 2 of the male terminal 1 is brought into contact with the elastic arm portion 12 and the lower surface portion 11*a* of the box frame body 11 or the contact piece portions 14. When a force for further inserting the male terminal 1 is applied from this state, the elastic arm portion 12 is deflected and deformed, and insertion of the tab portion 2 of the male terminal 1 is allowed. The male terminal 1 is inserted into the depth in the female terminal 10 while its tab portion 2 slides with the contact portion 13 and the contact piece portions 14 of the female terminal 10, respectively. Then, as illustrated in FIG. 1B, when the male terminal 1 has been inserted up to a contact completion position, a connecting work between the terminals is completed. The tab portion 2 of the male terminal 1 and the contact portion 13 of the female terminal 10 are in contact with each other only at contact points P where the first projecting wall 2*a* and the second projecting wall 13*a* overlap each other. That is, the first projecting walls 2*a* and the second projecting walls 13*a* are in contact with each other at the contact points P distributed in the grid shape. FIGS. 5A and 5B illustrate the contact points P by cross hatching.

Under the environment such as vibration, thermal shock, a temperature humidity cycle and the like, the male terminal 1 and the female terminal 10 connected to each other relatively and slightly slide with respect to each other.

If the abrasion powder Q of tinning or the like is generated on the tab portion 2 or the contact portion 13 by the relative sliding of the tab portion 2 and the contact portion 13, the abrasion powder Q moves by following the sliding of the tab portion 2 and the contact portion 13. Here, the contact points P of the tab portions 2 and the contact portions 13 are distributed in the grid shape. The abrasion powders Q located on these contact points P enter the first recess portion 2*b* and the second recess portion 13*b* when they move with the tab portion 2 and the contact portion 13 regardless of its moving direction. As a result, the amount of the abrasion powders Q present between the tab portion 2 and the contact portion 13 can be sufficiently reduced, and the increase of contact resistance caused by the abrasion powders Q can be effectively suppressed.

Here, if a projecting wall and a recess portion are provided only on either one side of the tab portion 2 and the contact portion 13, a pattern of planar contact between the tab portion 2 and the contact portion 13 becomes a stripe extending diagonally with respect to the sliding direction S. In this case, only the abrasion powders moving in a specific direction can enter the recess portion, and the abrasion powders cannot be effectively removed.

Particularly, in a terminal connecting structure assuming a low contact load, precious metal (Au, Ag) plating which is resistant against abrasion caused by slight sliding and provides connection reliability has been applied. In this embodiment, the abrasion powders can be removed from each of the projecting walls (contact surfaces) by the above described reason. Therefore, even if the contact connecting structure is applied with tinning, sufficient abrasion resistance against slight sliding can be obtained.

The widths and the depths of the first recess portion 2*b* and the second recess portion 13*b* are set to the widths and the depths equal to or larger than the expected maximum grain diameter of the abrasion powder Q. Therefore, the abrasion powders Q can be reliably made to enter the first recess portion 2*b* and the second recess portion 13*b*.

The inclination angle $\alpha$ of the first projecting wall 2*a* and the first recess portion 2*b* and the inclination angle $\beta$ of the second projecting wall 13*a* and the second recess portion 13*b* are set within the range of 30 to 60 degrees, respectively. Therefore, the abrasion powders Q can enter the first recess portion 2*b* and the second recess portion 13*b* with a short moving distance in any moving direction, and the abrasion powders Q can be removed effectively.

The inclination angle $\alpha$ on the male terminal 1 side and the inclination angle $\beta$ on the female terminal 10 side may be the same or may be different.

Figure 4B:
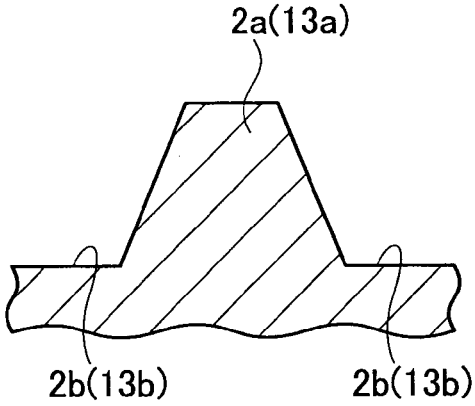
Figure 4C:
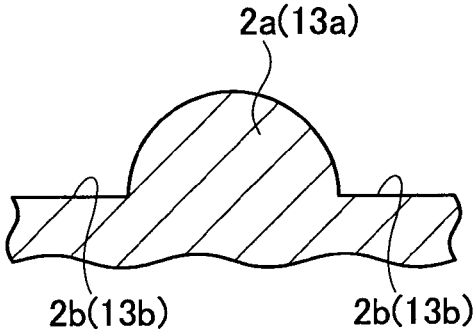

The sectional shapes of the first projecting wall 2*a* and the second projecting wall 13*a* are not limited to square illustrated in FIG. 4A. That is, these sectional shapes may be trapezoidal as illustrated in FIG. 4B or may be semicircular as illustrated in FIG. 4C. Moreover, shapes other than them may be used as long as the shape can smoothly enter the first recess portion 2*b* or the second recess portion 13*b* by rolling of the abrasion powder Q.

The projecting walls and the recess portions of the male terminal 1 and the female terminal 10 may be formed on any sliding surface of the both terminals. That is, positions where the projecting walls and the recess portions are formed are not limited to each of the sliding surfaces between the tab portion 2 of the male terminal 1 and the contact potion 13 of the female terminal 10 but may include each of the sliding surfaces between the tab portion 2 of the male terminal 1 and the contact piece portions 14 of the female terminal 10. However, on any sliding surface, the projecting wall and the recess portion are provided alternately.

What is claimed is:

1. A terminal connecting structure comprising:

a first terminal including a first contact portion; and a second terminal including a second contact portion configured to slide on the first contact portion, wherein a sliding surface of the first contact portion has a first projecting wall and a first recess portion provided alternately along a sliding direction of the first contact portion and the second contact portion, the first projecting wall and the first recess portion extend in a direction inclined with respect to the sliding direction; and a sliding surface of the second contact portion has a second projecting wall and a second recess portion provided alternately along the sliding direction, the second projecting wall and the second recess portion extend in a direction crossing the first projecting wall and the first recess portion and crossing the sliding direction.

2. The terminal connecting structure according to claim 1, wherein widths and depths of the first recess portion and the second recess portion are set to widths and depths equal to or larger than an expected maximum grain diameter of an abrasion powder.

3. The terminal connecting structure according to claim 1, wherein inclination angles of the first projecting wall and the first recess portion with respect to the sliding direction and inclination angles of the second projecting wall and the second recess portion with respect to the sliding direction are set within a range of 30 to 60 degrees, respectively.

4. The terminal connecting structure according to claim 2, wherein inclination angles of the first projecting wall and the first recess portion with respect to the sliding direction and inclination angles of the second projecting wall and the second recess portion with respect to the sliding direction are set within a range of 30 to 60 degrees, respectively.

5. The terminal connecting structure according to claim 1, wherein:

an expected grain diameter of an abrasion powder is approximately 0.1 to 10 μm; and widths and depths of the first recess portion and the second recess portion are set to 10 μm or larger.

6. The terminal connecting structure according to claim 1, wherein the second projecting wall and the second recess portion are inclined in a direction opposite to that of the first projecting wall and the first recess portion.

7. The terminal connecting structure according to claim 2, wherein the second projecting wall and the second recess portion are inclined in a direction opposite to that of the first projecting wall and the first recess portion.

8. The terminal connecting structure according to claim 3, wherein the second projecting wall and the second recess portion are inclined in a direction opposite to that of the first projecting wall and the first recess portion.

9. The terminal connecting structure according to claim 4, wherein the second projecting wall and the second recess portion are inclined in a direction opposite to that of the first projecting wall and the first recess portion.

10. The terminal connecting structure according to claim 1, wherein a sectional shape of one or more of: the first projecting wall and the second projecting wall comprises one of: a square sectional shape, a trapezoidal sectional shape, and a semicircular sectional shape.

11. The terminal connecting structure according to claim 1, wherein the first terminal comprises a male terminal and the second terminal comprises a female terminal.

12. The terminal connecting structure according to claim 1, wherein the first terminal comprises a male terminal and the second terminal comprises a female terminal formed with a box frame body, wherein a lower surface portion of the box frame body has two contact piece portions formed by bending.

13. The terminal connecting structure according to claim 12, wherein a tip end side of the male terminal is inserted into the box frame body of the female terminal and brought into contact with the contact piece portions.

14. The terminal connecting structure according to claim 13, wherein a sliding surface of the contact piece portions extends in a direction crossing the first projecting wall and the first recess portion and has a third projecting wall and a third recess portion provided alternately along the sliding direction.

15. The terminal connecting structure according to claim 1, wherein the first contact portion and the second contact portion contact with each other only at contact points where the first projecting wall and the second projecting wall overlap each other.

16. The terminal connecting structure according to claim 2, wherein the abrasion powder generated on the first contact portion or the second contact portion by relative sliding of the first contact portion and the second contact portion, moves into the first recessed portion or the second recessed portion by following the sliding of the first contact portion or the second contact portion.

17. The terminal connecting structure according to claim 16, wherein the first contact portion and the second contact portion are distributed in a grid shape; and the abrasion powder generated on the first contact portion or the second contact portion enter at least one of the first recess portion and the second recess portion regardless of a moving direction of the relative sliding of the first contact portion and the second contact portion such that an amount of the abrasion powder present between the relative sliding of the first contact portion and the second contact portion is reduced and an increase of contact resistance between the first contact portion and the second contact portion caused by the abrasion powders effectively suppressed.

18. The terminal connecting structure according to claim 16, wherein a sectional shape of one or more of the first projecting wall or the second projecting wall is configured such that the abrasion powder smoothly enters the first recess portion or the second recess portion by rolling.

19. The terminal connecting structure according to claim 1, wherein the first and second projecting walls and the first and second recess portions of the first terminal and the second terminal are formed on any sliding surface of the first terminal and the second terminal.

20. The terminal connecting structure according to claim 1, wherein the first and second projecting walls and the first and second recess portions are provided alternately on any sliding surfaces of the first terminal and the second terminal.

* * * * *